US005988881A

United States Patent [19]

Sutherland

[11] Patent Number: 5,988,881

[45] Date of Patent: Nov. 23, 1999

[54] PAPER SACK

[75] Inventor: Robert Sutherland, Aberdeen, United Kingdom

[73] Assignee: BPB PLC, Slough, United Kingdom

[21] Appl. No.: 09/099,484

[22] Filed: Jun. 17, 1998

[30] Foreign Application Priority Data

Jun. 18, 1997 [GB] United Kingdom ..... 9712819

[51] Int. Cl.[6] ..... B65D 33/01

[52] U.S. Cl. ..... 383/103; 383/32; 383/45

[58] Field of Search ..... 383/100, 101, 383/102, 103, 45, 54, 32

[56] References Cited

U.S. PATENT DOCUMENTS

| | | | |
|---|---|---|---|
| 2,046,146 | 6/1936 | Brady | 383/101 |
| 2,084,296 | 6/1937 | Eustis | 383/101 |
| 2,340,546 | 2/1944 | Meaker | 383/55 |
| 2,593,328 | 4/1952 | Meaker | 383/101 |
| 3,248,041 | 4/1966 | Burke | 383/101 |
| 4,672,684 | 6/1987 | Barnes et al. | 383/102 |

FOREIGN PATENT DOCUMENTS

| | | |
|---|---|---|
| 0 136 859 A2 | 4/1985 | European Pat. Off. . |
| 0 559 598 A1 | 9/1993 | European Pat. Off. . |
| 2 256 660 | 7/1975 | France . |
| 3202032 A1 | 8/1983 | Germany . |
| 83 22 642 U | 10/1983 | Germany . |
| 534964 | 3/1941 | United Kingdom . |
| 1 462 941 | 7/1975 | United Kingdom . |
| 2 116 144 | 9/1983 | United Kingdom . |

OTHER PUBLICATIONS

PCT International Search Report; PCT/GB98/01766; BPB PLC; Oct. 13, 1998.

*Primary Examiner*—Stephen P. Garbe

*Attorney, Agent, or Firm*—Christensen O'Connor Johnson & Kindness PLLC

[57] ABSTRACT

Multi-walled paper sacks for powder products, notably plaster, have a porous paper inner wall surrounded by a paper outer wall and a vapour barrier separate from the paper inner wall. The vapour barrier may be a coating on the inside face of the outer paper wall. Perforations through the vapour barrier are substantially confined to either or both of the broad faces of the sack. During filling of the sacks air is able to vent through the inner wall and then through the perforations in the vapour barrier, allowing filling by high speed machinery. Deterioration of the product as a result of moisture perforation is unexpectedly just as good, and sometimes superior, to that encountered with alternative sacks. Consequently the improvement in filling is not encumbered by a reduction in shelf life of the product.

20 Claims, 4 Drawing Sheets

PAPER SACK

FIELD AND BACKGROUND OF THE INVENTION

This invention relates to multi-wall paper sacks, and to powder products packaged in such sacks.

It is common practice for finely divided powder products to be packaged in multi-wall paper sacks provided with a filling opening—a so-called valve—at one end. To fill the sack, a filling nozzle is inserted into this opening and the powder is delivered from this nozzle into the sack. If the filling machine is operated at high speed it can be difficult for air to vent from the sack while it is being filled.

Some powder products, notably plaster and cement, react with water when used, and require protection from atmospheric moisture during storage. For this purpose it is conventional for a multi-wall sack to incorporate a vapour barrier between the walls of the sack, for instance a coating of polyethylene on the outer surface of an inner wall or on the inner surface of an outer wall.

It is possible to provide some perforations through sack walls to allow air to vent while the sack is being filled, even though these perforations penetrate a vapour barrier. This has been done in Europe and a form of sack which has been used extensively on high speed filling machines in United Kingdom has two walls with a vapour barrier on the outside of the inner wall; there are perforations through the wall and this vapour barrier over the whole of its area and a small number of perforations through both walls near the top of the sack.

SUMMARY OF THE INVENTION AND PREFERENCES

Broadly, the present invention provides a multi-wall paper sack for a powder product shaped to provide a pair of broad faces, i.e front and back faces, joined by side faces which are narrower than the front and back and also joined at top and bottom ends, which sack has a paper inner wall, which is porous, surrounded by a vapour barrier which is separate from the paper inner wall, and a paper outer wall. On either or both of the front and back faces there are perforations through the vapour barrier with an average density of perforation over the said face which is preferably at least 0.3 holes per $cm^2$, better at least 0.5 or 0.7 holes per $cm^2$.

The total number of perforations through the vapour barrier on the front or back face of the sack will usually exceed 500 and may exceed 1000.

The vapour barrier could be provided by means of a separate layer in between the innermost paper wall and the paper outer wall. More conveniently however it is provided as a coating on the inside surface of the paper outer wall and the perforations through the vapour barrier are perforations through the outer paper wall and the vapour barrier.

We have found that such a form of sack provides greatly improved filling on high speed machinery because it provides much more efficient venting of air while the sack is filled.

The porous paper innermost wall appears to provide effective passage of air venting from the interior of the bag, yet is a barrier to dust, allowing the perforations through the outer wall to remain open.

By contrast, while experimenting with double walled sacks having a vapour barrier on the innermost wall, we observed that even quite large perforations with a diameter of 3 mm became clogged with powder during filling and were less effective at venting air.

Sacks in accordance with this invention may be utilised when filling of the sacks takes place through a nozzle inserted into an aperture provided at an otherwise closed end of a sack, and the filling of a sack is carried out in less than 12 seconds, and possibly in shorter times such as less than 10 or less than 8 seconds.

Thus in a second aspect this invention provides a method of packaging a powder product, which comprises providing sacks as set forth above which include a filling aperture, inserting a filling nozzle into that aperture of a sack, and filling the sack. Preferably the time for filling does not exceed 12 seconds.

Although the expulsion of air during filling is improved, there is surprisingly little deterioration in the protection of the bag contents from atmospheric moisture during storage, compared to sacks where an outer paper wall shields perforations through the inner wall and a vapour barrier coated thereon.

At each of the side walls, the density of perforations through the vapour barrier is preferably not greater than 0.1 hole per $cm^2$. Yet more preferably the total number of perforations through the vapour barrier at each side wall is not greater than 50 at most.

If the perforation of the side walls is kept to a low level, in accordance with this preferred feature of the invention, most of the filled sacks in a stack will have the perforations through the front and back faces blocked by other sacks above and below them in the stack. For the same reason, it is preferred that on each perforated face of the sack, the perforations are confined to a band which is spaced inwardly from the side edges.

We have found that such sacks then provide improved protection of their contents from atmospheric moisture, as well as providing improved filling. Sacks at the top of the stack provide adequate protection for their own contents. Thus, overall, there can be improvements in both the filling of the sacks and the protection of the sacks' contents from moisture during storage.

According to a development of this invention, perforations are substantially confined to the front face or the back face of the sack, but not both of them. It is then possible to stack the filled sacks so that every sack in the stack has its single perforated face lying against another sack. Alternatively a vapour barrier can be provided at the face of the stack where perforations would otherwise be exposed.

In a third aspect, this invention provides the use of a sack as above to enhance the storage stability of a moisture-sensitive powder product packaged therein. As mentioned above, the inner wall of a sack must be porous. Almost any paper which does not carry a vapour barrier is porous to some extent. Preferably however, the paper has an air resistance (Gurley) of not more than 15 seconds better not more than 10 seconds. The Gurley method for testing the air permeance of paper is a standard method in which a test piece of paper blocks the flow of air from a cylinder as a second cylinder slides within it. The time for a standard volume of air to flow through the paper is observed. The test method is set out in British standard 6538 part 3 (1987) which corresponds to ISO5636/5.

The inner wall preferably has a weight in the range from 50 or 60 up to 120 gm per $m^2$. Paper with a weight exceeding 60 gm per $m^2$ and an air resistance below 10 seconds is commercially available. Suppliers include Korsnas in Sweden and UPM-Kymmene in Finland. It is envisaged that the inner wall will have few, if any perforations through it. For instance, the density of perforations (if any) through the inner wall, averaged over its whole area, may be less than 0.1 holes per $cm^2$.

The outer wall is preferably paper with a weight in the range from 60 or 80 up to 130 gm per $m^2$. The vapour barrier is conveniently provided as a polymer coating, for instance a polyethylene coating, on this paper.

It is within the scope of this invention for the sack to have more than two walls. The vapour barrier could for example be provided on a middle wall, in which case the outer wall might have fewer perforations than the vapour barrier.

Sacks according to this invention will usually have a cuboidal shape when filled. The length from end to end may lie in the range from 25 or 30 cm up to 80 cm, width in the range from 15 or 20 cm up to to 70 cm and thickness from front to back in a range from 7, better 9 cm up to 15, 20 or even 25 cm.

Individual perforations can be small holes, with a diameter less than 2 mm and usually with a diameter less than 1 mm.

DETAILED DESCRIPTION AND EMBODIMENTS

Figure 1:
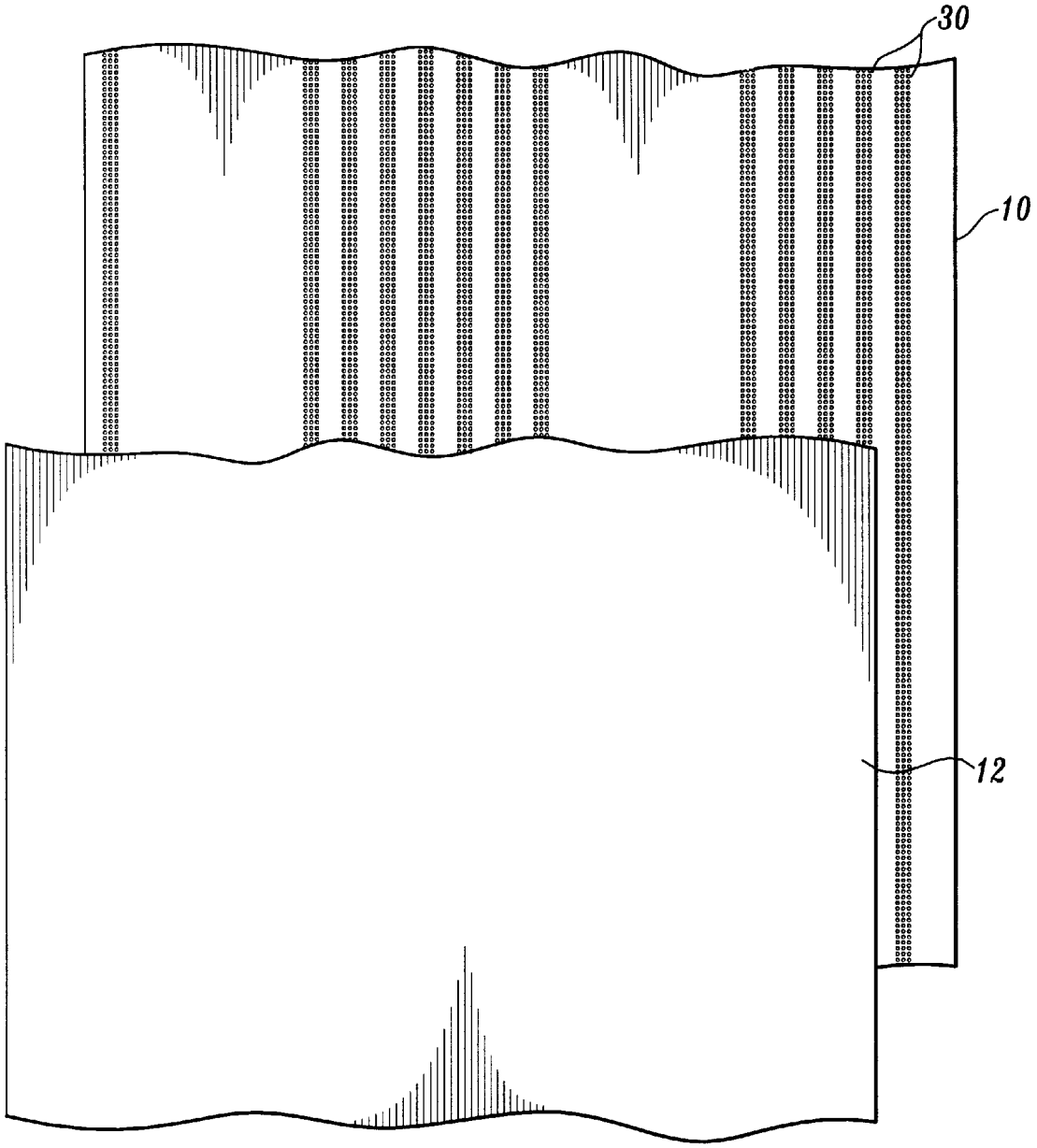
FIG. 1 diagrammatically illustrates paper webs used to make sacks.
Figure 4:
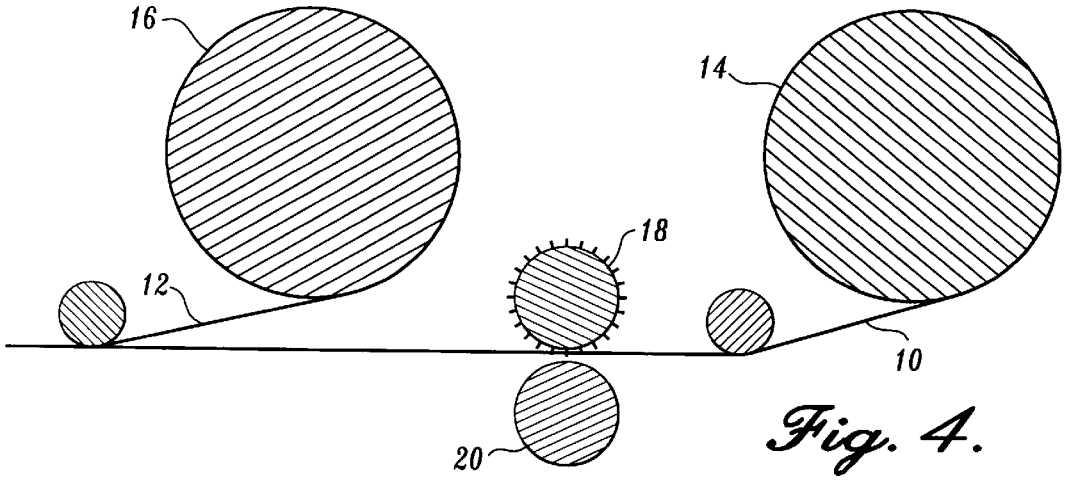
FIG. 4 shows the unreeling and perforation of the webs.

Embodiments of the invention will now be described by way of example with reference to the above drawings:

As illustrated in FIGS. 1 and 4 two paper webs are used to form bags embodying this invention. The paper web 10 forms the outer wall of the bags while the paper web 12 forms the inner wall. The web 12 consists of kraft paper only. In this example embodiment it has a porosity such that its air resistance (Gurley) is approximately 5 seconds. The weight of the paper is 80 $gm/m^2$.

The web 10 which provides the outer wall of the sacks is kraft paper with a weight of 95 $gm/m^2$ coated on one surface (which becomes the interior of the outer wall) with 15 $gm/m^2$ of polyethylene providing a vapour barrier. The two webs are drawn off supply rollers 14 and 16 and brought together. Before the two webs are brought together the web 10 is passed between a roller 18 bearing an array of needles and a counter roller 20 with a soft surface. The needles on roller 18 make bands of perforations in the web 10.

Figure 3:
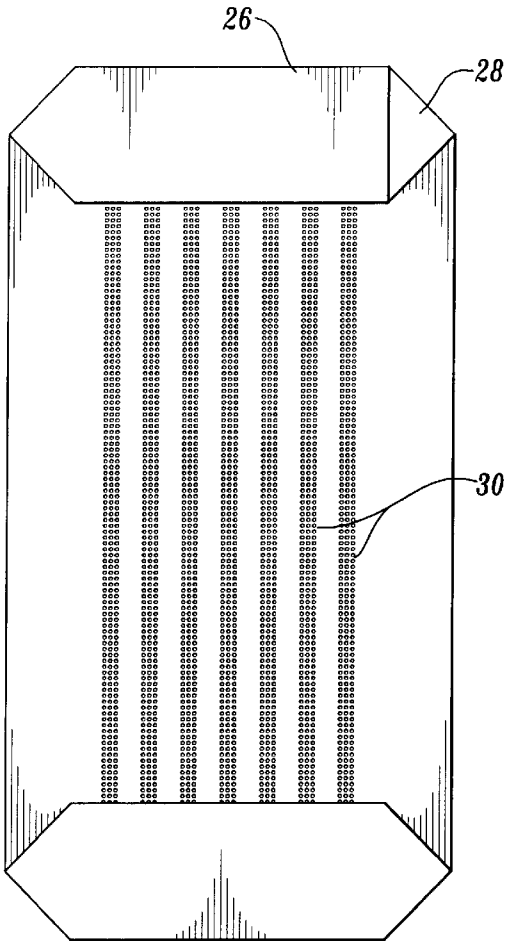
FIG. 3 shows a finished bag in flattened form.
Figure 2:
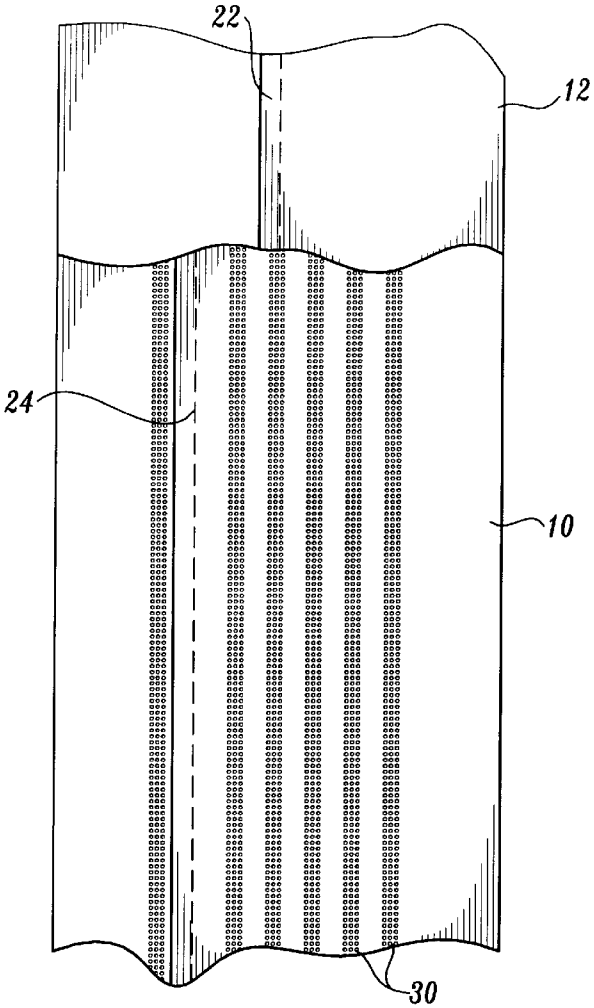
FIG. 2 diagrammatically illustrates the formation of the webs into tubular form.

The two webs are formed in known manner into a continuous flattened tube as shown in FIG. 2 in which the overlapping side edge portions of web 12 are glued together at 22 and overlapping side edge portions of web 10 are glued together at 24 so that the tube has an inner wall formed from the web 12 and an outer wall formed form the web 10. This tube is cut into lengths and in a subsequent operation each of the cut-off lengths is cut, folded and glued at its ends, so as to form a flattened sack as illustrated by FIG. 3. At the bottom end of the sack the folded over portions of the walls which form the sack bottom are covered over by a strip of paper glued onto them. At the top end of the sack an additional piece of paper is inserted and glued in place between folded over portions of the walls and a cover strip is also glued on at the exterior. The result is to leave a filling opening between the composite end panel 26 and the folded in portions 28.

The forming of webs into a continuous multi-wall tube which is then cut to length and the subsequent cutting, creasing and glueing of the end portions of each of the cut lengths so as to form sacks are well known operations in paper sack manufacture and can be carried out on automatic machinery.

Figure 5:
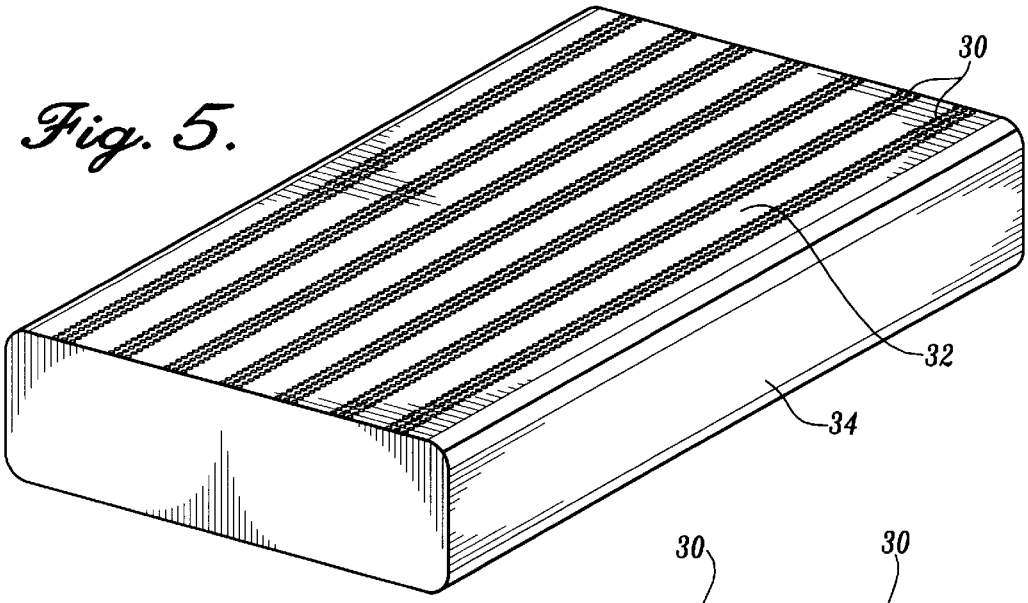
FIG. 5 shows a bag in its filled condition.

The needle roller 18 which perforates the web 10 has the needles in groups positioned on the roller so as to form bands 30 of perforations which are confined to those portions of the web 10 which become the front and back faces of the finished sack. As illustrated by FIG. 5, there are bands 30 of perforations on the front face 32 of the sack, but there is none on the side faces 34. The bands on the front face 32 are spaced inwardly from the side edges by about 4 cm. On the back face, not seen in FIG. 5, the bands of perforations are again spaced from the side edges of that face.

Although the bands of perforations extend onto the flaps which form the ends of the sack, they are here covered by the glued-on cover strips and by gluing together of the inner and outer walls at the ends.

In this example each band 30 of perforations contains three lines of perforations, 0.5 cm apart, with the perforations in each line spaced 0.6 cm apart. Each band of perforations therefore contains 5 holes per centimetre along its length. The centre lines of the bands of perforations are spaced 3 cm apart. This pattern of perforations is illustrated by the detail view at FIG. 6. Of course other patterns of perforations could be used.

In this example the sack is 31 cm wide, 51 cm high (i.e length between the top and bottom ends) and 11 cm thick when filled. The front and back faces each has an area of approximately 1600 $cm^2$. Since each band 30 of perforations contains 5 holes per linear centimetre, the total number of holes through each of the front and back faces exceeds 1000 and indeed is in the region of 1500. The density of perforation exceeds 0.8 holes per $cm^2$.

There are no perforations through any part of the inner wall 12 nor through the side faces 34 of the outer wall of the sack. In the embodiment described above, the needles which were making the perforations pierced the web 10 from its inside face carrying the vapour barrier. However, it would be possible to pierce the web 10 from its printed surface which becomes the exterior of the sack.

The arrangement and manufacturing procedure described above with reference to the drawings is given by way of example. A number of variations would be possible. Notably, it is possible that the two webs of paper 10, 12 are brought together as shown in FIG. 4 but then temporarily separated once again as they pass through the automatic machinery which carries out paper sack manufacture. Perforation of the web 10 could therefore be carried out at such a point in the machinery where the two webs have been temporarily separated.

Figure 6:
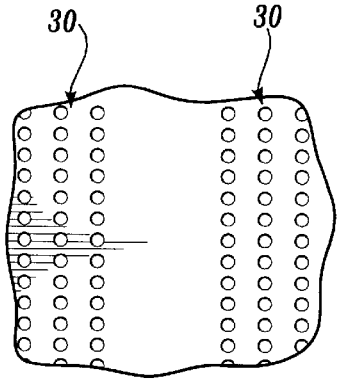
FIG. 6 is a detail view of part of a band of perforations.

There are a number of possibilities for varying the pattern of holes on a face of the sack. If the holes are created as bands of perforations in the manner shown in the drawings it is not necessary that the bands contain equal densities of holes. Even when the bands do contain an equal density of perforations it is not essential that the holes in one band are aligned with holes in another band. When a band of perforations contains more than one line of perforations as illustrated by FIG. 6, it is not essential that the lines of perforations are in alignment with each other and in particular the central line of three might be longitudinally offset relative to the lines of perforations at either side of it.

Figure 8:
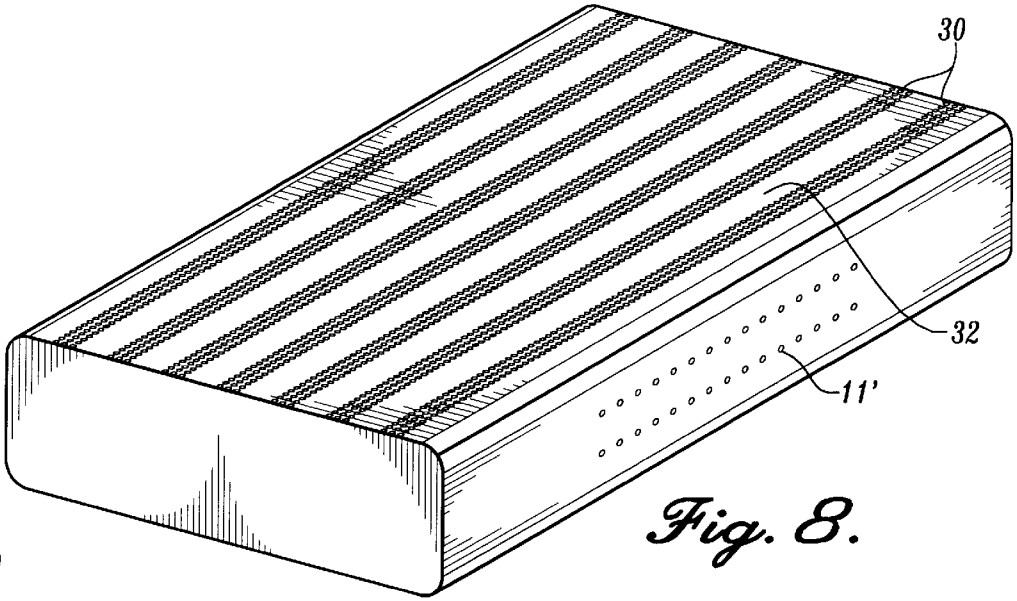
FIG. 8 shows another embodiment of a bag in its filled condition.
Figure 7:
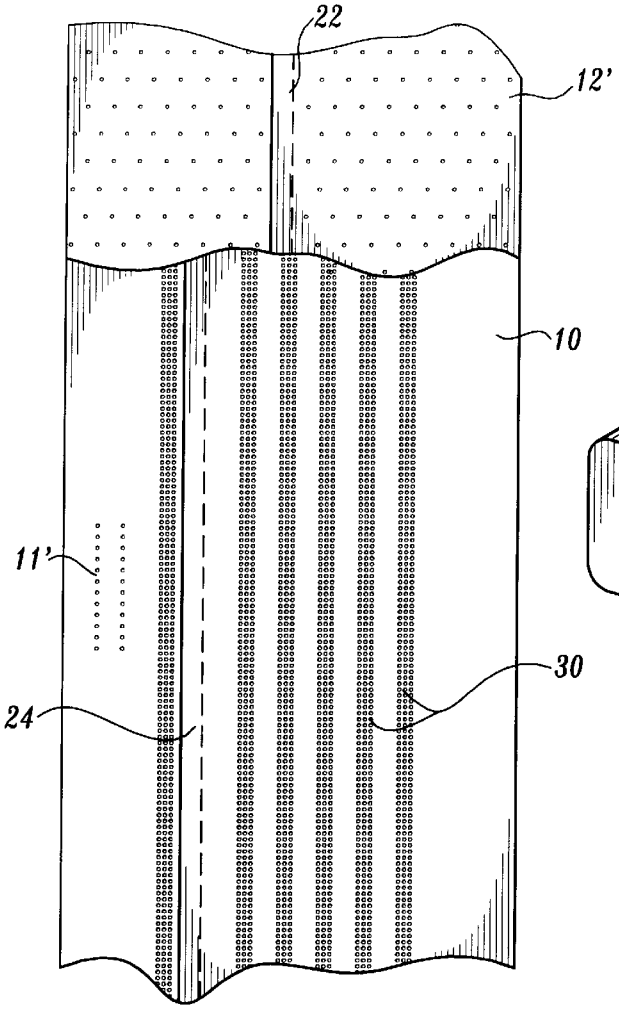
FIG. 7 diagrammatically illustrates another embodiment of the formation of the webs into tubular form.

Other embodiments of the sack are shown in FIG. 7 and FIG. 8. FIG. 7, illustrates perforations in the sidewall 11' of the sack and also through the inner wall 12' of the sack. FIG. 8, illustrates perforations through the sidewall 11'.

When the sacks have been filled they are stacked horizontally on a pallet. For most of the sacks on the pallet there will be no access to the broad front and back faces of the sack because these are lying directly against a broad face of the sack below or a broad face of the sack above.

In order to block access to the sacks at the bottom of a stack, a sheet of vapour barrier material may be laid on a pallet before sacks are stacked onto that pallet. Such a sheet could be a sheet of polyethylene film or, more conveniently, could be a sheet cut from a web 10 but without any perforations. Similarly, to block access to the top sacks on the pallet a similar sheet can be laid across the sacks at the top of the pallet before securing the entire stack of sacks onto the pallet.

EXAMPLE 1

A number of sacks generally as described above were manufactured. Eight bands 30 of perforations were provided on each of the broad faces, giving an average density of perforation on these faces of approximately 1.2 holes per $cm^2$. These sacks were filled with plaster on a high speed filling machine having a plurality of filling nozzles, operating such that an individual sack is filled with 25 kg of plaster in a time of approximately 7 seconds. (Even faster times, less than 5 seconds, are possible)

The plaster is a powder with particle size less than 3000 micrometres, and with a substantial proportion of fine particles with a size less than 250 micrometers.

As a comparison, the machine was used to fill double wall sacks of the same size, where the vapour barrier was provided as an outer coating on the inner wall, the outer wall was uncoated kraft paper with an air resistance (Gurley) of approximately 16 seconds and the vapour barrier and inner wall were perforated over their side faces and much of their front and back faces with approximately 1.5 holes per $cm^2$.

The sacks embodying the invention were observed to fill easily, and did not become distended with trapped air. Less plaster dust escaped during filling and the bursting of sacks during filling and subsequent handling was reduced.

Filled sacks of each kind were stacked horizontally on pallets. Some sacks were laid as single layers on separate pallets, to represent a top layer. At intervals sacks from within the stacks were taken out, and the plaster in them was tested. Sample sacks from the single layers were also tested. The tests on the plaster measured trowelling times and water gauge.

When the sacks were kept in a single layer, plaster in sacks embodying this invention and plaster in the comparison sacks underwent a progressive change in properties during a period of 80 days. The changes were substantially equal in magnitude with both kinds of sack. When the sacks were stacked in layers on a pallet, plaster in sacks from within the stacks (i.e. not from the top-layer) showed less change in properties during the same period. In this case, however, plaster in the sacks embodying the invention showed less change in properties during the storage period than plaster in the comparison sacks.

The number of perforations through faces of the sack required to give sufficient venting of air during filling can vary from one filling machine to another and can be determined by experimental trials. For example, after trial of the sacks in this example it was found possible to reduce the number of bands of perforations in the back faces of the sacks from eight bands to seven. In further trials with a different filling machine it was found possible to reduce the number of bands of perforation to only four bands on each of the front and back faces.

EXAMPLE 2

In a further comparative trial, three types of sacks were made and filled with plaster. The first type of sack was similar to those described in Example 1 with a variation that the web 10, which provides the outer wall of the sacks was kraft paper with a weight of 80 $g/m^2$ coated on one surface, which again became the interior of the outer wall, with 14 $g/m^2$ of polyethylene as the vapour barrier.

The second category of sacks made and tested was the same as the first category except that the perforations through the outer web were confined to only one of the broad faces of the sacks (approximately halving the total number of perforations).

As a comparison, the third group of sacks which were made and filled were the same as those used as a comparison in the previous example.

Both categories of sacks embodying the invention were observed to fill easily and did not become distended with trapped air. As in the previous example, filled sacks of each kind were stacked horizontally on pallets. Before the sacks were stacked on the pallets the surface of the pallet was covered with a sheet of paper bearing a polyethylene coating. This was the same as the coated paper of web 10, but this sheet was not perforated and served to provide a vapour barrier between the pallet and the bottom of layer of sacks in the stack. In the case of the sacks with perforations through one broad face only, all the sacks were stacked on the pallet with the perforations facing downwards. Consequently, all of these sacks were stacked with their perforated faces lying directly against another sack or, in the case of the bottom layer, lying directly against the vapour barrier laid on the pallet.

As in the previous example, sacks were taken out from the stacks at intervals and the plaster in them was tested. The tests measured trowelling times and water gauge. Results obtained are set out in the following tables:

| Storage time (days) | Comparative | Perforations on both faces | Perforations on one face |
|---|---|---|---|
| Water Gauge (%) — Sacks on Pallet | | | |
| 5 | 48.1 | 47.7 | 48.6 |
| 21 | 48.1 | 48.4 | 49.2 |
| 34 | 47.7 | 47.8 | 49.0 |
| 47 | 46.9 | 47.4 | 48.7 |
| 61 | 46.9 | 47.1 | 48.9 |
| 83 | 46.0 | 46.6 | 47.3 |
| 110 | 46.2 | 45.9 | 48.5 |
| 138 | 43.6 | 43.1 | 44.4 |
| Trowelling times to final polish (min) — Sacks on Pallets | | | |
| 5 | 95 | 90 | 85 |
| 21 | 105 | 95 | 90 |

-continued

| Storage time (days) | Comparative | Perforations on both faces | Perforations on one face |
|---|---|---|---|
| 34 | 110 | 100 | 100 |
| 47 | 105 | 95 | 95 |
| 61 | 110 | 100 | 100 |
| 83 | 110 | 105 | 100 |
| 110 | 105 | 95 | 90 |
| 138 | 135 | 135 | 120 |
| 185 | — | — | 125 |

Similar trials were carried out on plaster taken from sacks which were allowed to stand separately rather than in a stack on pallets. The results are set out in the following tables:

| Storage time (days) | Comparative | Perforations on both faces | Perforations on one face |
|---|---|---|---|
| Water Gauge (%) — Bags Stored Separately | | | |
| 5 | 48.1 | 47.7 | 48.6 |
| 21 | 46.0 | 46.2 | 48.6 |
| 34 | 44.3 | 44.9 | 47.6 |
| 47 | 43.9 | 43.8 | 46.6 |
| 61 | 43.0 | 42.7 | 45.7 |
| 83 | 42.3 | 42.6 | 44.6 |
| Trowelling times to final polish (min) Bags Stored Separately | | | |
| 5 | 95 | 90 | 85 |
| 21 | 115 | 105 | 105 |
| 34 | 140 | 120 | 110 |
| 47 | 145 | 125 | 110 |
| 61 | 145 | 130 | 110 |
| 83 | 115 | 130 | 115 |
| 110 | — | 125 | 120 |

It is apparent from these results that the deterioration during storage was no worse for plaster stored in bags according to the invention and perforated on both sides than for plaster stored in conventional bags. The bags according to the invention with perforations at only one of the broad faces gave even better preservation of the plaster. Thus, these bags not only gave improved filling but an improvement in shelf life as well.

As would be expected, plaster in bags stored separately changed more rapidly than the plaster in bags stacked on a pallet. Here both types of bag according to the invention gave an improvement in storage life. These trial results were confirmed by comments from the plasterers carrying out the tests.

I claim:

1. A multi-wall paper sack for a powder product which is affected by contact with moisture, the sack shaped to provide a pair of opposite broad faces joined by side faces which are narrower than the broad faces and also joined at top and bottom ends, which sack has a paper inner wall, which is porous, surrounded by a vapour barrier which is separate from the paper inner wall, and a paper outer wall, at least one of the broad faces having perforations through the vapour barrier formed by mechanical needle punching with an average density of perforation over said at least one face exceeding 0.3 holes per $cm^2$ and the side faces having substantially no perforations through the vapour barrier.

2. A sack according to claim 1 wherein the said perforations are provided over one broad face only.

3. A sack according to claim 1 wherein the average density of perforation through said at least one broad face exceeds 0.7 holes per $cm^2$.

4. A sack according to claim 1 wherein the total number of perforations through the vapour barrier on said at least one broad face of the sack exceeds 500.

5. A sack according to claim 1 wherein the vapour barrier is provided as a coating on the inside surface of the paper outer wall and the perforations through the vapour barrier are perforations through the outer paper wall and the vapour barrier.

6. A sack according to claim 1 wherein the inner layer is sufficiently porous that it has an air resistance (Gurley) of not more than 10 seconds.

7. A sack according to claim 1 wherein the inner paper wall has perforations therethrough, the number of perforations through the inner wall of the sack being sufficiently small that the average density thereof is less than 0.1 holes per $cm^2$.

8. A sack according to claim 1 having a length in the range from 30 to 80 cm, a width in the range from 20 to 70 cm and a thickness in the range from 7 to 20 cm where at least one broad face of the sack has at least 500 perforations through the vapour barrier.

9. A sack according to claim 8 wherein the average density of perforation through said at least one broad face exceeds 0.7 holes per $cm^2$, wherein the vapour barrier is provided as a coating on the inside surface of the paper outer wall and the perforations through the vapour barrier are perforations through the outer paper wall and the vapour barrier, and wherein the inner layer is sufficiently porous that it has an air resistance (Gurley) of not more than 10 seconds.

10. A sack according to claim 9 wherein the paper inner wall has substantially no perforations therethrough.

11. A sack according to claim 9 wherein the paper inner wall has perforations therethrough, the number of perforations through the paper inner wall of the sack being sufficiently small that the average density thereof is less than 0.1 holes per $cm^2$.

12. A sack according to claim 1, wherein the powder product is plaster.

13. A sack according to claim 1 wherein the paper inner wall has substantially no perforations therethrough.

14. A multi-wall paper sack for a powder product which is affected by contact with moisture, the sack shaped to provide a pair of opposite broad faces joined by side faces which are narrower than the broad faces and also joined at top and bottom ends, which sack has a paper inner wall, which is porous, surrounded by a vapour barrier which is separate from the paper inner wall, and a paper outer wall, at least one of the broad faces having perforations through the vapour barrier formed by mechanical needle punching with an average density of perforation over said at least one face exceeding 0.3 holes per $cm^2$, and the side faces having perforations through the vapour barrier, the number of perforations through the vapour barrier at each side of the sack being sufficiently small that the average density thereof over the side faces is less than 0.1 holes per $cm^2$.

15. A sack according to claim 14 wherein the total number of perforations through the vapour barrier at each side wall does not exceed 50.

16. A sack according to claim 14 wherein the perforations are provided over one broad face only.

17. A sack according to claim 14 wherein the paper inner wall has substantially no perforations therethrough.

18. A sack according to claim 14 wherein the paper inner wall has perforations therethrough, the number of perforations through the paper inner wall of the sack being sufficiently small that the average density thereof is less than 0.1 holes per $cm^2$.

19. A multi-wall paper sack for a powder product which is affected by contact with moisture, the sack shaped to provide a pair of opposite broad faces joined by side faces which are narrower than the broad faces and also joined at the top and bottom ends, which sack has a paper inner wall, which is porous, surrounded by a vapour barrier which is separate from the paper inner wall, and a paper outer wall, at least one of the broad faces having perforations through the vapour barrier formed by mechanical needle punching with an average density of perforation over said at least one face exceeding 0.3 holes per $cm^2$, the side faces having substantially no perforations through the vapour barrier, and the inner paper wall having substantially no perforations therethrough.

20. A paper sack according to claim 19 wherein the said perforations are provided over one broad face only.

* * * * *